US011629020B2

(12) United States Patent
Miyahara

(10) Patent No.: US 11,629,020 B2
(45) Date of Patent: Apr. 18, 2023

(54) PAPER CONVEYING DEVICE, IMAGE READING DEVICE, AND IMAGE FORMING APPARATUS

(71) Applicant: CANON KABUSHIKI KAISHA, Tokyo (JP)

(72) Inventor: Katsutoshi Miyahara, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/113,841

(22) Filed: Dec. 7, 2020

(65) Prior Publication Data

US 2021/0171303 A1 Jun. 10, 2021

(30) Foreign Application Priority Data

Dec. 9, 2019 (JP) ..... JP2019-221953

(51) Int. Cl.

| | |
|---|---|
| ***B65H 29/12*** | (2006.01) |
| ***B65H 43/08*** | (2006.01) |
| ***B65H 7/14*** | (2006.01) |
| ***B65H 5/06*** | (2006.01) |
| *B65H 15/00* | (2006.01) |

(52) U.S. Cl.

CPC ..... *B65H 7/14* (2013.01); *B65H 5/062* (2013.01); *B65H 15/004* (2020.08); *B65H 2404/70* (2013.01); *B65H 2553/46* (2013.01)

(58) Field of Classification Search

CPC ..... B65H 29/125; B65H 29/12; B65H 29/52; B65H 5/062; B65H 43/08; B65H 7/14; B65H 7/02; B65H 15/004; B65H 2404/70; B65H 2553/46; B65H 2553/414; B65H 2301/3122; B65H 2511/22; B65H 2511/15

See application file for complete search history.

(56) References Cited

U.S. PATENT DOCUMENTS

| | | | | |
|---|---|---|---|---|
| 6,726,197 | B2 * | 4/2004 | Aoki | B65H 29/00 271/3.06 |
| 7,942,413 | B2 * | 5/2011 | Eguchi | G03G 15/6552 271/278 |
| 2017/0362045 | A1 * | 12/2017 | Masuda | B41J 11/703 |

FOREIGN PATENT DOCUMENTS

| | | | |
|---|---|---|---|
| JP | 2005072740 | A | 3/2005 |
| JP | 2013184764 | A * | 9/2013 |
| JP | 2013184765 | A * | 9/2013 |

* cited by examiner

*Primary Examiner* — Luis A Gonzalez

(74) *Attorney, Agent, or Firm* — Canon U.S.A., Inc. IP Division

(57) ABSTRACT

A paper conveying device, used in a paper processing device to perform predetermined processing on paper, includes a conveying portion, a holding portion, a detection portion, and a control portion. The conveying portion conveys, in a conveying direction, the paper to a processing portion of the paper processing device. The holding portion is disposed downstream of the processing portion in the conveying direction and holds the paper processed by the paper processing device. The detection portion detects a change of an orientation of the paper held by the holding portion. The control portion releases the paper held by the holding portion in a case where an amount of the detected orientation change reaches a predetermined amount.

32 Claims, 7 Drawing Sheets

PAPER CONVEYING DEVICE, IMAGE READING DEVICE, AND IMAGE FORMING APPARATUS

BACKGROUND

Field

The present disclosure relates to a paper conveying technique.

Description of the Related Art

Generally, for a scanner unit of a multifunction printer (hereinafter, MFP) for large-size paper, a sheet feed method, is frequently used, in which a document (paper) is fed to a fixed line sensor before being read in order to achieve a size reduction of a main body. Among documents read by a sheet-feed scanner, small documents are ejected into a document receiving tray, but large documents or long documents may go over the receiving tray and be dropped out of the scanner. Japanese Patent Application Publication No. 2005-72740 discloses an apparatus configured to stop a part of a read document in a state where the document held by a document ejection roller in accordance with a length of the document, in order to prevent the document from dropping out of the apparatus.

Under some circumstances, an apparatus having a document ejection roller may need to hold a document. However, when a document is partially held by the document ejection roller in order to prevent drop of the document, the holding state of the document by the document ejection roller has to be cancelled when a user collects the document. One method of cancelling the holding state of the document is to provide a document ejection key on an operation panel for the user to press the same. In this case, the user needs to operate the panel with one hand while holding the document with the other hand. In a case of a large document, when the holding state of the document is cancelled, the document may be bent by the weight thereof and may be scratched or creased depending upon how the document is held by the user. There is another method in which, a document in a holding state is pulled and is collected by rotating a conveying roller with the pulling force, however, in the case of a thin document, the document may be torn by the pulling force.

SUMMARY

A paper conveying device disclosed herein may be used for a paper processing device. In a case where paper is a held for a paper conveying device configured to hold processed paper including read documents, the paper conveying device may utilize a technique disclosed herein capable of improving convenience of paper collection by a user after the paper is held by the paper conveying device.

According to an aspect of the present disclosure, a paper conveying device used in a paper processing device to perform predetermined processing on paper, the paper conveying device includes a conveying portion configured to convey, in a conveying direction, the paper to a processing portion of the paper processing device, a holding portion disposed downstream of the processing portion in the conveying direction and configured to hold the paper processed by the paper processing device, a detection portion configured to detect a change of an orientation of the paper held by the holding portion, and a control portion configured to release the paper held by the holding portion in a case where an amount of the detected orientation change reaches a predetermined amount.

The present disclosure can improve convenience of collecting paper by a user after the paper is held in a paper conveying device configured to hold processed paper including read documents.

Further features of the present disclosure will become apparent from the following description of exemplary embodiments with reference to the attached drawings.

DESCRIPTION OF THE EMBODIMENTS

An embodiment for implementing the present disclosure will be exemplarily described in detail with reference to the accompanying drawings. However, the dimensions, materials, shapes, and relative arrangements of components described in the embodiment may be optionally changed according to conditions and a configuration to which the disclosure is applied. In other words, the scope of the disclosure is not limited to the following embodiment.

In all examples, a sheet-feed scanner will be illustrated. The application of the present disclosure is not limited to such a scanner. The present disclosure is also applicable to other automatic paper conveying devices having similar configurations.

EXAMPLE 1

Figure 1A:
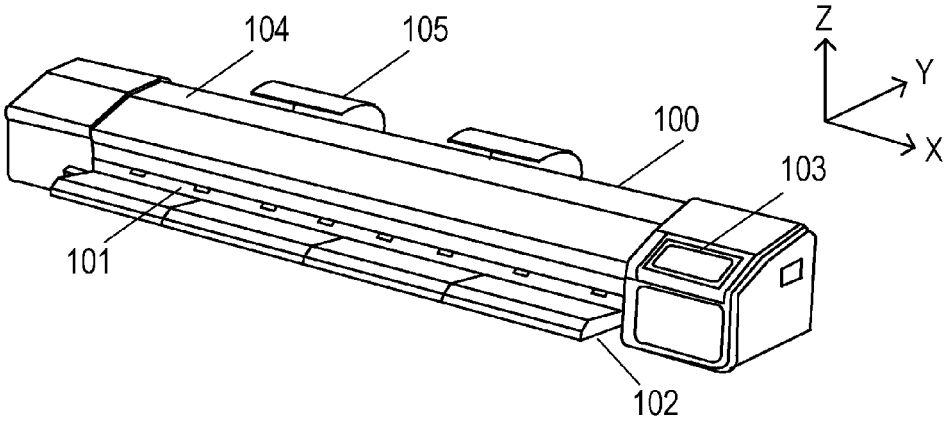
FIGS. 1A to 1C are schematic diagrams illustrating the configuration of a scanner according to an example of the present disclosure.
Figure 1B:
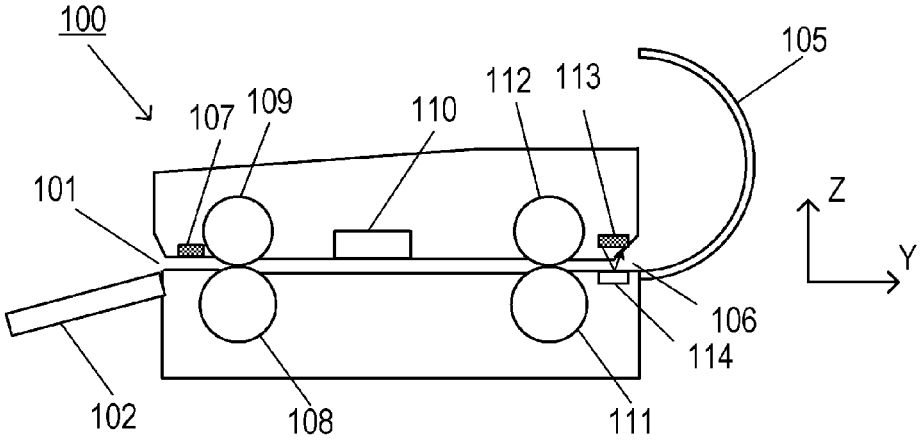
Figure 1C:
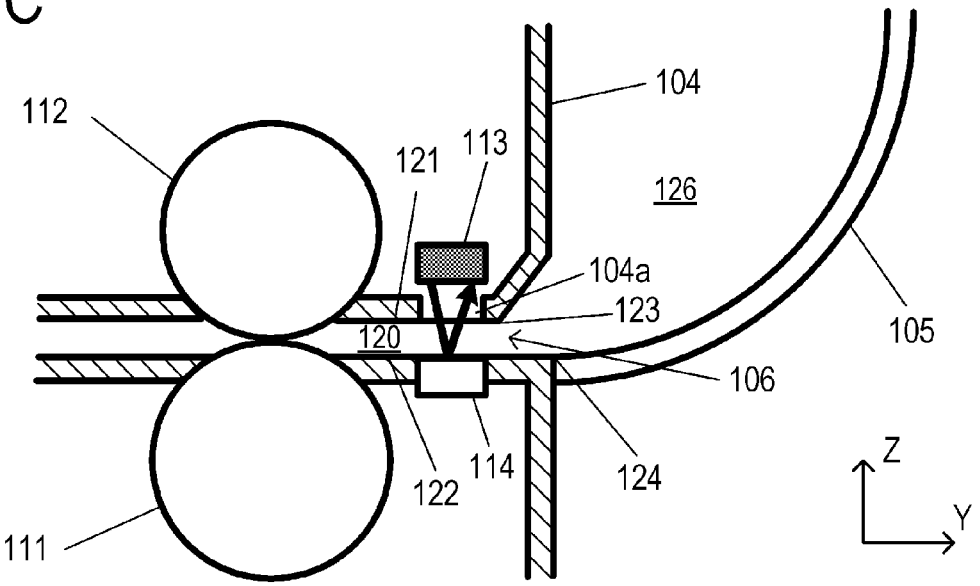

FIGS. 1A to 1C are schematic diagrams illustrating the configuration of a large sheet-feed scanner 100 as an example of an automatic sheet conveying device according to the embodiment of the present disclosure. FIG. 1A is an external perspective view, FIG. 1B is a cross-sectional view, and FIG. 1C is an enlarged view around a document outlet 106 of FIG. 1B.

The scanner 100 includes a document inlet 101 and a document feed tray 102 at the front of the body. The leading end of a document is loaded on the document feed tray 102 such that the central portion of the document in the width direction of the document (X direction) is located at the center of the document inlet 101 in the width direction of the document, and then the document is inserted into the document inlet 101 so as to slide on the tray. The document inserted into the document inlet 101 on a conveying path in the scanner 100 is conveyed substantially in a horizontal direction (Y direction) that is a predetermined conveying direction orthogonal to the width direction of the document (X direction). The document inlet 101 is designed such that a certain degree of displacement or inclination of a document inserted by a user is acceptable with respect to the width of the document readable by the scanner 100. In FIGS. 1A to 1C, Z direction indicates an upward direction of gravitational force. The conveying direction of a document on the conveying path in the scanner 100 is typically a horizontal direction. A document may be conveyed in a direction other than the horizontal direction.

The scanner 100 is provided with an operation portion 103 including a physical key and an LCD panel on the top surface of the body, allowing a user to input the setting of reading conditions and a document size. On the top surface of the scanner 100, a top cover 104 is provided. The top cover 104 is opened upward to allow access into the scanner 100, so that maintenance can be performed on the body. At the rear of the scanner 100 (downstream in the conveying direction), a paper ejection guide (paper-ejection guide portion) 105 is attached. The paper ejection guide 105 is curled like a letter U, allowing a user, from the front of the body, to collect a document ejected from the rear. In other words, the paper ejection guide 105 guides an ejected document 401 such that the document bends upward and backward toward the upstream side of the conveying direction. The paper ejection guide 105 is detachable from the body of the scanner 100. In the case of a thick document that is hard to curl along the paper ejection guide 105, the paper ejection guide 105 is detached to allow the ejection of the document rearward from the scanner.

Specifically, in a typical usage pattern, the front side (user side) of the body or the front surface of the body of the scanner 100 is a side where a user faces the scanner 100 when operating the scanner 100. The document inlet 101 is opened at the front side of the body and the operation part 103 is oriented to the front side of the body so as to facilitate operations by a user who faces the front (near) side of the body or the front surface of the body of the scanner 100.

In the cross-sectional view of FIG. 1B, the document inlet (insertion opening, inlet opening) 101 is disposed on the left and the document outlet (ejection opening, outlet opening) 106 is disposed on the right. Regarding the schematic cross-sectional view of FIG. 1B, a vertical direction in a normal installation state of the scanner 100 corresponds to the vertical direction of the drawing, the left side of the drawing corresponds to the front (near) side of the body or the front surface side of the body, and the right side of the drawing corresponds to the rear side of the body or the backside of the body. In many cases, for example, the scanner 100 to be used is installed above a printer (image recording portion) and the installation is not specifically limited (see FIG. 7, will be specifically described later).

Near the document inlet 101, a document sensor 107, which is a reflection optical sensor, is installed. The document sensor 107 emits light to the reading surface of a document inserted into the document inlet 101, thereby detecting the presence or absence of a document according to reflected light.

Behind the document sensor 107 (downstream of the conveying direction), a document conveying roller 108 and an upstream-side pinch roller 109 are disposed so as to nip a document. The document conveying roller 108 is connected to a conveying motor 208 (see FIG. 2) via a gear. A document can be conveyed by the document conveying roller 108 and the upstream-side pinch roller 109 that are rotated by the rotation of the conveying motor 208.

Line image sensors 110 are disposed downstream of the document conveying roller 108. A document retaining plate, which is not illustrated, is set to face the reading surface of the line image sensor 110 and presses a document onto the line image sensor 110 with a spring force. The scanner 100 of the present embodiment is provided with the five small line image sensors 110 arranged in X direction in order to read large documents.

Downstream of the line image sensors 110, a document ejection roller 111 and a downstream-side pinch roller 112 are disposed so as to nip a document. The document ejection roller 111 is connected to the document conveying roller 108 via a belt. A document is ejected to the document outlet 106 by the document ejection roller 111 and the downstream-side pinch roller 112 that are rotated by the rotation of the conveying motor 208. The document ejection roller 111 and the downstream-side pinch roller 112 of the present example act as a paper holding unit and a paper conveying unit of the present disclosure and correspond to a downstream-side conveying roller pair. The document conveying roller 108 and the upstream-side pinch roller 109 are included in the conveying portion of the present disclosure and correspond to an upstream-side conveying roller pair.

In other words, the document conveying roller 108 and the document ejection roller 111 are configured so as to receive a rotary force transmitted from the conveying motor 208 and rotate in an interlocked manner with a belt, which is not illustrated. The upstream-side pinch roller 109 and the downstream-side pinch roller 112 are pressed to the document conveying roller 108 and the document ejection roller 111 by an urging force of a spring (urging member), which is not illustrated, and form a nip portion for nipping and conveying a document. The upstream-side pinch roller 109 and the downstream-side pinch roller 112 are rotated by the rotations of the document conveying roller 108 and the document ejection roller 111 and are kept in a stopped state by the urging force when the document conveying roller 108 and the document ejection roller 111 are stopped. Various configurations may be used as the specific configurations of the conveying portion and the holding portion of the present disclosure as long as the conveying of paper and the holding of paper in a stop time are ensured. Thus, the present disclosure is not limited to the foregoing configuration.

At a central portion of the document outlet 106 (a central portion in the width direction of a document), a document state sensor 113 (hereinafter, may be referred to as "sensor 113") is disposed as a detection portion. The sensor 113 is an optical range sensor including a light source for illuminating a measuring object (detection target) with detection light and a light receiving portion for receiving light reflected from the measuring object. A light receiving unit used in the light receiving portion has a two-dimensional light receiving surface and can measure a distance from an object such as a work piece by using an analog output value that changes according to the light receiving position of reflected light. In other words, the position of the optical axis of detection light received by the light receiving portion changes according to a distance between the light source and a detection target and an analog output value corresponding to the position of the optical axis is outputted as a detection result.

As illustrated in FIG. 1C, the top cover 104 is provided with an opening 104*a*. The measured distance of the document state sensor 113 is regulated (light that can enter the light receiving part of the sensor 113 is limited in order to improve detection accuracy) by the shape of the opening 104*a*. A reflector plate 114 capable of reflecting light from the sensor 113 is provided so as to face the sensor 113. The sensor 113 is designed so as to detect a distance from a document placed in a range (about 10 mm) from the opening 104*a* of the top cover 104 to the reflector plate 114.

As the light receiving portion of the sensor 113, the light receiving unit that changes the analog output value according to the reception position of reflected light is used in order to suppress the influence of an image on the accuracy of detection when the image is formed at the measurement position of a document. For example, by using a position sensitive detector (PSD), an output can be obtained according to the irradiation position of the optical axis of reflected light regardless of the intensity of the reflected light. Thus, when the state of a document changes, the influence of a change of an image state (e.g., an image concentration) on a measurement surface can be negligible.

Figure 2:
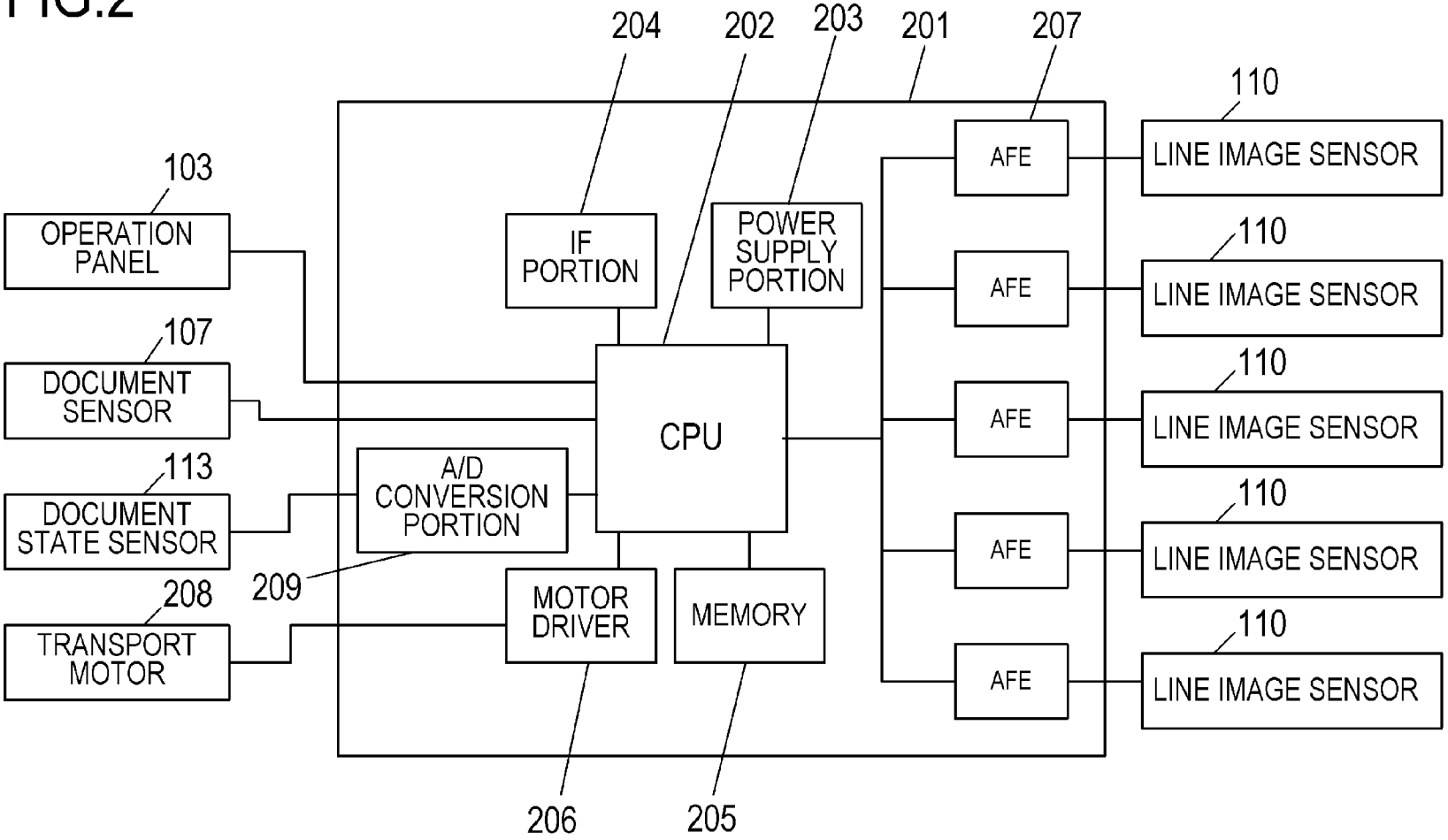
FIG. 2 is an electric block diagram illustrating the internal configuration of the scanner according to the example of the present disclosure.

FIG. 2 is a block diagram for explaining the configuration of the scanner 100 according to the present example. The scanner 100 includes a controller board 201 that acts as a control portion and controls sensors and an actuator. A CPU 202 is mounted on the controller board 201 and is connected to a power supply portion 203, an interface (IF) portion 204, a memory 205, a motor driver 206, analog front ends (AFEs) 207, the operation panel 103, and the sensors. The power supply portion 203 includes a circuit for converting power supplied from the outside into a voltage used for driving the controller board 201, the sensors, and the actuator. The IF unit 204 includes a control circuit for an LAN or a USB or the like and connects a PC or a network to the CPU 202 so as to allow data communications. The memory 205 is used as a buffer for storing a program for driving the CPU 202 and processing image reading data acquired from the line image sensors 110. Moreover, the memory 205 is used for holding a threshold value for determining ejection control that is performed based on the output of the sensor 113. The motor driver 206 is provided for driving the conveying motor 208 serving as a stepping motor. The motor driver 206 outputs a motor driving signal in response to a control signal inputted from the CPU 202. The AFEs 207 are provided for converting analog reading signals outputted from the line image sensors 110 into digital data and include one or more circuits as many as the number of line image sensors 110. The operation panel 103 is operated by a user to operate the scanner 100 and includes an LCD, a touch panel, and physical keys. The LCD displays a menu and a notification and the user starts a scanning operation or changes the setting by operating the touch panel. The physical keys include a start key, a stop key, and an ejection key. An A/D conversion portion 209 is a circuit for converting an analog signal outputted from the sensor 113 into digital data.

Figure 3:
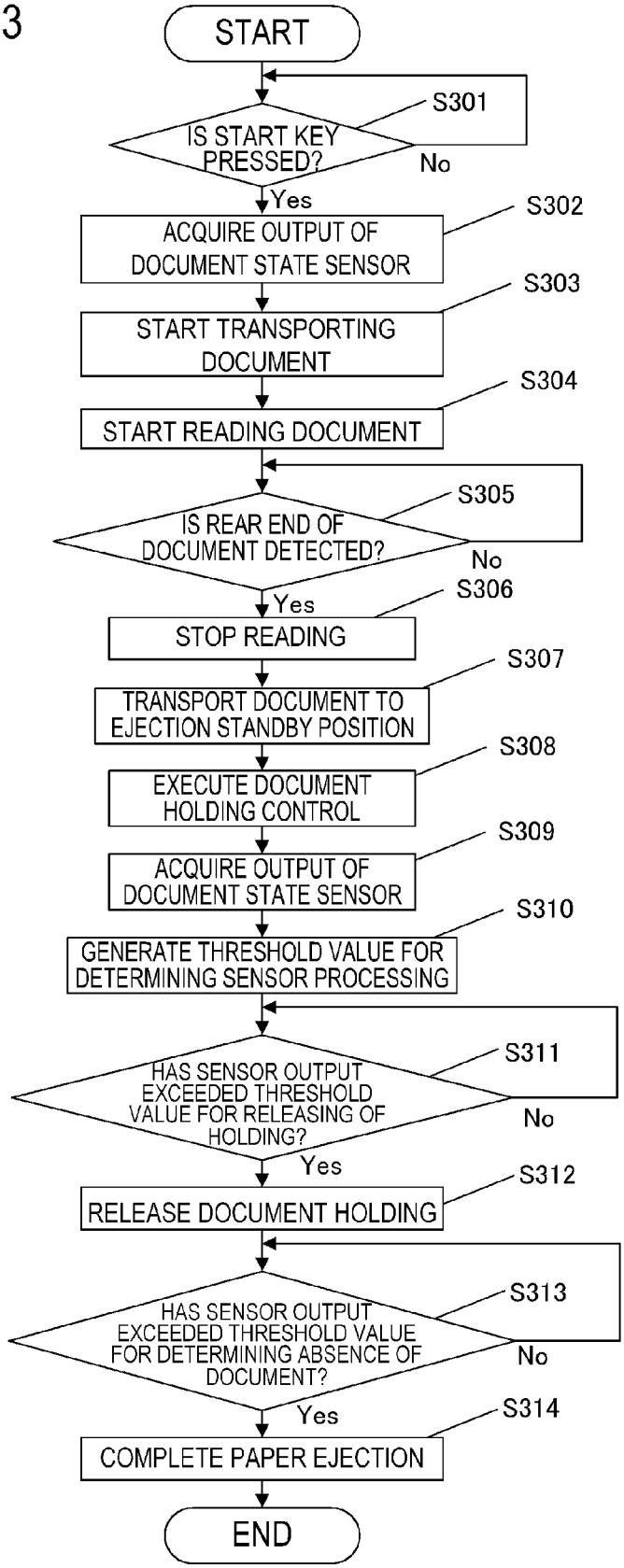
FIG. 3 is a flowchart showing a series of operations of the scanner according to the example of the present disclosure.
Figure 4A:
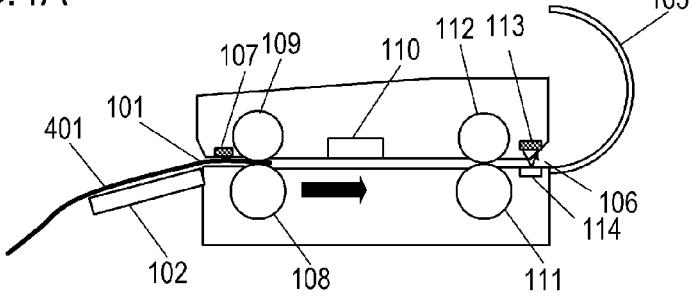
FIGS. 4A to 4E are schematic cross-sectional views illustrating the states of a document.
Figure 4B:
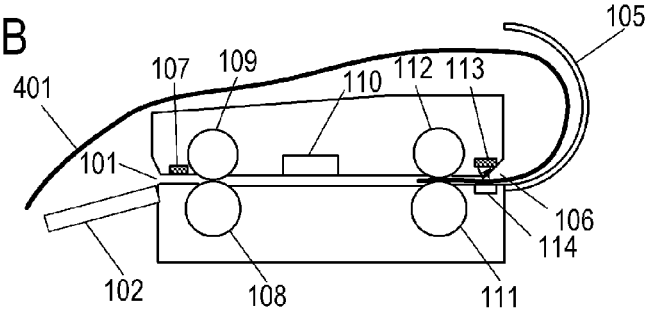
Figure 4C:
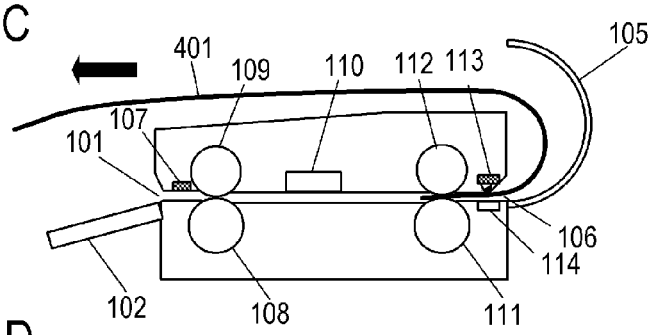
Figure 4D:
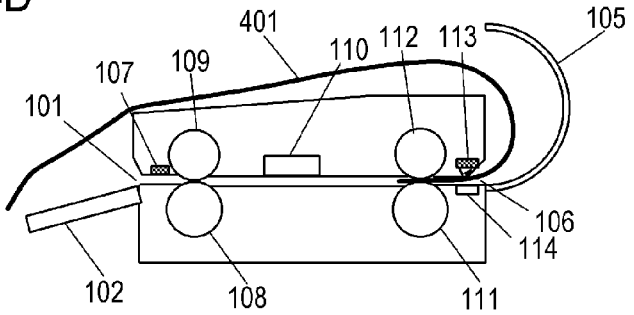
Figure 4E:
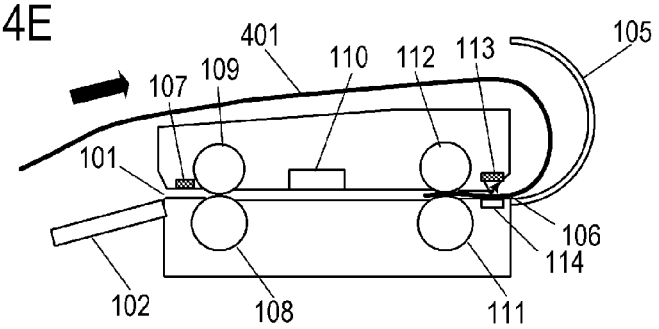
Figure 5A:
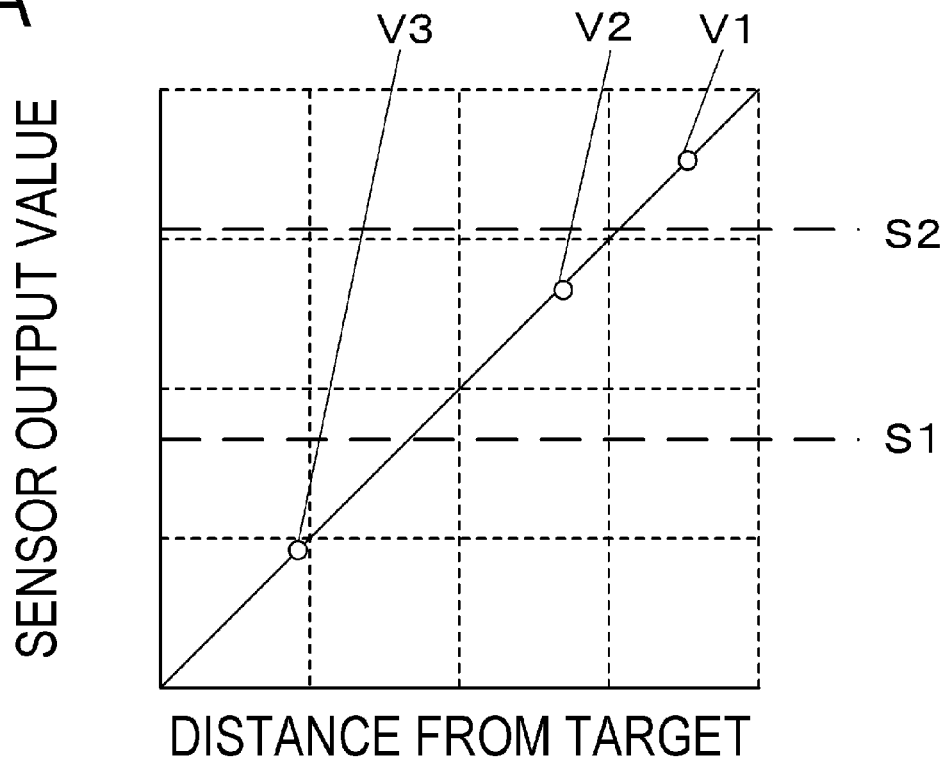
FIGS. 5A and 5B are output tables indicating an output relative to a distance between a state sensor and a detection target.
Figure 5B:
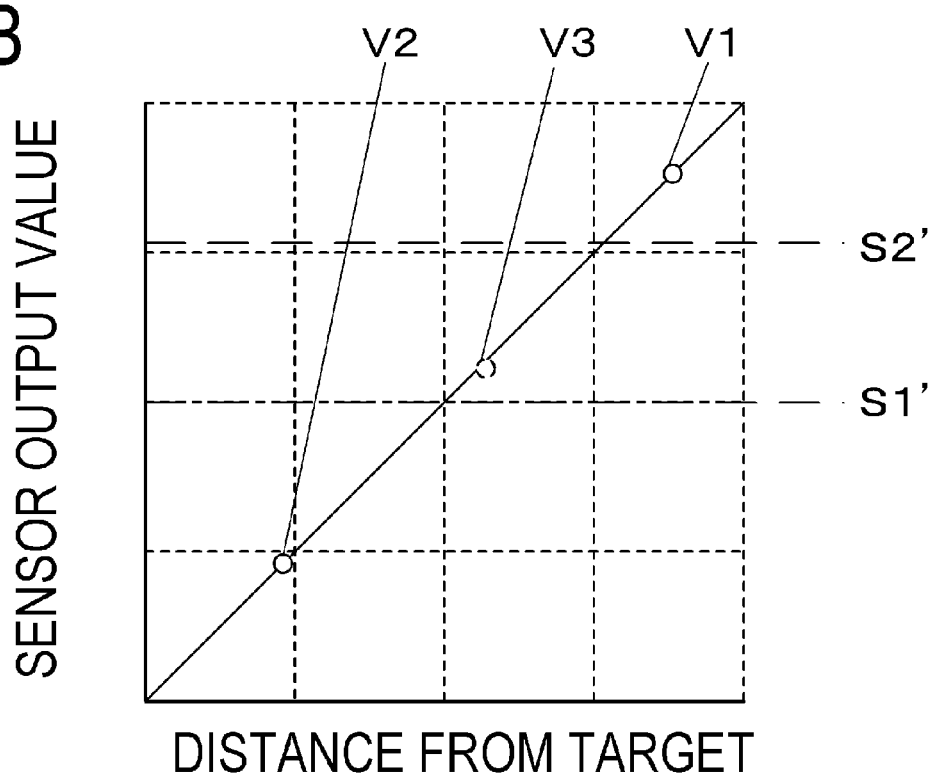

Referring to FIGS. 3 to 5A and 5B, the ejection of a document according to the present example will be described below. FIG. 3 is a flowchart for explaining a flow from the reading of a document, which is set on the scanner 100 described in the present example, to the ejection of the document. FIGS. 4A to 4E are cross-sectional views illustrating the states of a document 401 and the detection states of the sensor 113 in the scanner 100. FIGS. 5A and 5B are output tables for explaining the relationship between an output level and a distance from the sensor 113 to a detection target.

For reading the document 401, the document 401 is to be set on the scanner 100 in advance by a user. When the user inserts the document 401 into the document inlet 101, the document sensor 107 detects the document 401 and transmits a signal to the CPU 202. The CPU 202 transmits the control signal to the motor driver 206 and rotates the conveying motor 208, so that the document conveying roller 108 is rotated to draw the document 401 into the conveying path. When the document 401 reaches a reading starting position opposed to the image sensors 110, the rotation of the conveying motor 208 is stopped, so that the conveying is stopped. In this state, for example, the setting of reading is changed in response to an operation on the operation panel 103.

The scanner 100 waits for a press on the start key of the operation panel 103 while the document 401 is placed on standby for reading. In response to a press on the start key by a user, the scanner 100 starts a reading operation (S301). When the start key is pressed, the CPU 202 acquires the output of the sensor 113. The output of the sensor 113 is converted from an analog value to a digital value by the A/D conversion portion 209 on the controller board and is inputted to the CPU 202. The CPU 202 records, in the memory 205, the digitized output value as an output value in the absence of the document 401 at the document outlet 106 (S302). In other words, the absence of the document 401 in the detection range of the sensor 113 for detecting a change of the orientation of the document 401 is detected. Thus, a reference value is obtained for detecting a change of the orientation of the document 401 and the absence of the document 401 in the holding portion (nip portion) (that is, a state in which a conveying operation can be stopped). The CPU 202 then transmits the control signal to the motor driver 206 and rotates the conveying motor 208, so that the conveying of the document 401 is started (S303). The conveying of the document 401 is accelerated before the leading end of the document reaches the line image sensors 110, and the conveying speed is kept constant during a reading period.

The CPU 202 calculates the position of the document in the conveying direction based on the control signal to the motor driver 206. When the CPU 202 determines that the leading end of the document 401 has reached the line image sensors 110, a driving signal is transmitted to the line image sensors 110 and the AFE 207 and a reading operation of the document 401 is started (S304). Data outputted from the line image sensor 110 is converted into a digital value in the AFE 207 and then the digital value is inputted to the CPU 202. The CPU 202 performs processing for converting the data inputted from each of the line image sensors 110 into a segment of image data and stores the data in the memory 205. The stored image data is sequentially read from the outside through the IF portion 204.

In a reading period of the conveyed document 401, the rear end of the document 401 is detected by the document sensor 107 as paper rear-end detection (S305). The document 401 is continuously conveyed and the rear end of the document 401 passes through the detection area of the document sensor 107, so that the output signal of the document sensor 107 is changed and the CPU 202 detects the position of the rear end of the document 401. The CPU 202 determines, based on the detected position of the rear end, a position for terminating the reading operation of the document 401. When the document 401 reaches the position, the CPU 202 stops of the control signals of the line image sensors 110 and the AFE 207 and terminates the reading operation (S306). After the reading operation is terminated, the CPU 202 controls the driving of the conveying motor 208 so as to stop the rear end of the document 401 at a predetermined position (S307).

In a state in which the rotation of the conveying motor 208 is stopped, as illustrated in FIG. 4B, the rear end of the document 401 is held between the document ejection roller 111 and the downstream-side pinch roller 112. Meanwhile, the leading end of the document 401 is ejected to the outside from the document outlet 106 and is guided toward the front side of the body by the paper ejection guide 105. In order to lock the rotation of the document ejection roller 111 so as to prevent the document 401 from falling out of the scanner by the weight of the document, the CPU 202 controls the motor driver 206 to energize the conveying motor 208 (S308).

The CPU 202 acquires the output of the sensor 113 in a state in which the conveying of the document 401 is stopped and the rotation of the document ejection roller 111 is locked (S309). In the state of FIG. 4B, the document 401 is disposed in the detection region of the sensor 113. Thus, the sensor 113 outputs a detection signal (second detected distance) for a distance shortened by at least the thickness of the document 401 in contrast to an output (first detected distance) in the absence of the document 401 in the detection region in FIG. 4A. The output from the sensor 113 is converted into a digital value by the A/D conversion portion 209 with a constant period and is inputted to the CPU 202. The CPU 202 performs filtering by using data segments consecutively acquired to remove the influence of noise from the acquired signal of the sensor 113.

Subsequently, a threshold value for starting an ejecting operation (releasing operation) of the document 401 is generated by using the filtered detection signal and the detection signal acquired in the absence of the document 401 at the document outlet 106 before the start of a reading operation (S310). Upon the generation of the threshold value, the CPU 202 determines whether to set a higher value or a lower value than the output level (second detected distance) of the sensor 113 immediately after reading. Specifically, it is determined whether the orientation of the document 401 is (i) a separated orientation in which a part of the document 401 included in the detection range of the sensor 113 is located near the remotest position from the sensor 113 or (ii) a close orientation in which the part is located near the closest position to the sensor 113.

As illustrated in FIG. 4B, if the document 401 is relatively thick and is curled (gently arc-shaped) toward the front side of the scanner along the paper ejection guide 105, the document 401 is laid in contact with the reflector plate 114 near the document outlet 106 (that is, the separated orientation).

V1 in FIG. 5A is a plot of the output level of the sensor 113 in the absence of the document 401 near the document outlet 106. In the absence of the document 401, an output (first detected distance), corresponding to a distance to the reflector plate 114 to be opposed to the document, is obtained.

V2 indicates the output level of the sensor 113 immediately after the reading of the document.

In the presence of the document 401 in contact with the reflector plate 114 at the document outlet 106, the output of the sensor 113 has a value corresponding to a distance obtained by reducing the thickness of the document 401 from the distance to the reflector plate 114.

The CPU 202 compares a difference between the output V1 of the sensor 113 in the absence of the document and the output V2 of the sensor 113 in the presence of the document with a predetermined value. If the difference (absolute value as a magnitude of a number without regard to its sign or relation to other numbers) is smaller than the predetermined value, a threshold value for determining the ejection of the document 401 is obtained as a value lower than V2. In other words, the predetermined value is a reference value for determining whether the orientation of the document 401 is (i) the separated orientation or (ii) the close orientation. A value corresponding to, for example, the thickness or material of the document 401 and the configuration of the conveying path of the scanner can be experimentally determined in advance. If the absolute value of a difference between the output V1 (first detected distance) and the output V2 (second detected distance) is smaller than the reference value, (i) the separated orientation is determined as the orientation of the document and a threshold value (first threshold value) for a value smaller than V2 (a distance shorter than the second detected distance) is set. An approximate value (nearest reference value) is recorded in advance. The approximate value is obtained when the document 401 comes into contact with the opening 104*a* of the sensor 113 (the opening 104*a* is closed). An intermediate value between the approximate value and the value of V2 is set as an ejection-control start threshold value S1 (first threshold value) of the document 401. The intermediate value is set to have a certain margin from a state in which the document 401 is in contact with the opening 104*a* of the sensor 113. The setting is not particularly limited. Additionally, an intermediate value between V1 and V2 is determined and is set as a threshold value S2 (second threshold value) for stopping the ejection control of the document 401 when the document 401 is collected and is not left around the document outlet 106.

In another state of the document 401 immediately after reading, if the document 401 is thin or long, as illustrated in FIG. 4D, the document 401 ejected toward the front side of the scanner may be brought into contact with the opening 104*a* of the sensor 113 (close orientation) by the weight of the document 401. V2 in FIG. 5B indicates the output level of the sensor 113 immediately after the reading of the document. As illustrated in FIG. 5B, if the document 401 is in contact with the opening 104*a* of the sensor 113 formed on the top cover 104 (the opening 104*a* is closed), the output of the sensor 113 has a minimum value (shortest detected distance) in the output level range of the sensor 113. In this case, the absolute value of a difference between the output V1 (first detected distance) and the output V2 (second detected distance) is at least (equal to or higher than) the reference value, so that the CPU 202 can determine the orientation of the document 401 is the close orientation. Hence, the threshold value (first threshold value) for determining the ejection of the document 401 is set higher than V2. Alternatively, a difference between the value of V2 and the recorded approximate value (nearest reference value), which is obtained when the document 401 comes into contact with the opening 104*a* of the sensor 113, is compared with a predetermined value. If the difference is smaller than the predetermined value, the threshold value (first threshold value) for determining the ejection of the document 401 may be set higher than V2. In this case, an intermediate value between the output level V1 of the sensor 113 in the absence of the document 401 around the document outlet 106 and the output level V2 of the sensor 113 immediately after reading is set as an ejection-control-start threshold value S1' of the document 401. An intermediate value between S1' and V1 is set as a threshold value S2' for terminating the ejection control of the document 401. S2' may be a value experimentally determined based on a difference between V1 and V2, that is, the thickness of the document 401.

If the document 401 can be brought close to or separated from the sensor 113 by a user operation depending upon the state of the document 401, both of the threshold values S1 and S1' can be generated and set. The generation of the threshold values is not limited to the foregoing contents. Any other methods may be used as long as the orientation of the document 401 can be properly determined and the threshold values can be properly set.

After the completion of the generation of the threshold values, the threshold values generated by the CPU 202 and the output of the sensor 113 are periodically compared with each other and it is determined whether the output of the sensor 113 has reached any one of the threshold values S1, S1', S2, and S2' (S311). After the completion of the reading of the document 401, if the document 401 is not operated by a user, a distance between the sensor 113 and the document 401 is not changed and, thus, the output of the sensor 113 is kept constant and does not exceed the threshold values. If a user confirms the completion of the reading of the document 401 through the display on the operation panel 103, holds the right and left ends of the document 401 with both hands in order to collect the document 401, and gently pulls the document 401 toward the user, a distance between the sensor 113 and the document 401 is changed to vary the output of the sensor 113.

In the state of FIG. 4B, if a user holds both ends of the document 401 in order to collect the document 401 and gently pulls the document 401 toward the user, the document 401 sharply curves around the document outlet 106 and a distance between the sensor 113 and the document 401 is shortened as illustrated in FIG. 4C. When a distance between the sensor 113 and the document 401 becomes shorter than a certain distance, the output of the sensor 113 is smaller than the threshold value S1 as indicated by V3 in FIG. 5A, so that the CPU 202 determines that the output of the sensor 113 has reached the threshold value S1.

After the reading of the document 401, if the document 401 is in contact with the opening 104*a* of the sensor 113 as illustrated in FIG. 4D and a user holds both ends of the document 401 in order to collect the document 401 and slightly lifts the document 401, the document 401 gently curves around the document outlet 106 and a distance between the document 401 and the opening 104*a* of the sensor 113 increases as illustrated in FIG. 4E. When a distance between the sensor 113 and the document 401 reaches a certain distance, the output of the sensor 113 is larger than the threshold value S1' as indicated by V3 in FIG. 5B, so that the CPU 202 determines that the output of the sensor 113 has reached the threshold value S1'.

If the output of the sensor 113 exceeds any one of the threshold values, the CPU 202 determines that an amount of change of the orientation of the document 401 has exceeded a predetermined amount, and performs an ejecting operation (control for restarting the rotation of the downstream-side conveying roller pair) for cancelling the retaining control of the document 401 and ejecting the document 401 (S312). In order to eject the document 401, the CPU 202 transmits the control signal to the motor driver 206 and rotates the conveying motor 208. In response to the rotation of the conveying motor 208, the document ejection roller 111 is rotated to eject the rear end of the held document 401 out of the document outlet 106. The user holding both ends of the document 401 with both hands can collect the document 401 without dropping or bending the document 401.

As illustrated in FIG. 1C, the document 401 to be subjected to image reading by the scanner 100 is conveyed substantially in a horizontal direction, which is a predetermined conveying direction, in a predetermined range around the line image sensors 110 on a conveying path in the scanner 100. In a region outside the predetermined range, that is, a region closer to the viewer than (upstream of) the document inlet 101 or a region downstream of the document outlet 106, the document 401 is conveyed in any form (conveyed in any conveying direction). Specifically, in the conveying path of the document 401, a downstream-side conveying path 120 is formed between the document ejection roller 111 and the downstream-side pinch roller 112, which act as a holding portion, and the document outlet 106. The downstream-side conveying path 120 is a small ejection space where a change of the orientation of the document 401 is limited. The downstream-side conveying path 120 includes an upper guide portion 121 for guiding the top surface of the document 401 and a lower guide portion 122 for guiding the underside of the document 401. The guide portions limit a vertical change of the orientation of the document 401 to a predetermined range. Downstream of the document outlet 106 at the downstream end of the downstream-side conveying path 120, an ejection space 126 is formed. The ejection space 126 accepts a change of the orientation of the document 401 as compared with the downstream-side conveying path 120. The sensor 113 is disposed near the downstream end of the downstream-side conveying path 120, that is, near a downstream end 123 (the upper edge of the document outlet 106) of the upper guide portion 121 forming the document outlet 106 and a downstream end 124 (the lower edge of the document outlet 106) of the lower guide portion 122.

The sensor 113 is preferably disposed at a location where a change of the orientation of the document 401 is limited to a certain range. That is to say, an upper limit and a lower limit are easily set and a portion susceptible to a displacement according to a change of the orientation of the document 401 can be detected. After image reading, the document 401 is held such that the document 401 has mostly passed through the document outlet 106 on the downstream side of the conveying direction and is partially left upstream of the document outlet 106 on the upstream side of the conveying direction. In a part where the document 401 is left upstream of the document outlet 106 in the conveying direction, the upstream end is fixed while being nipped by the document ejection roller 111 and the downstream-side pinch roller 112. Downstream of the fixed end in the conveying direction, the orientation of the held document 401 can be freely changed such as without meaningful restriction. In the downstream-side conveying path 120 where a change of the orientation of the document 401 is limited to the predetermined range, a part of the document 401 is stored such that flexibility in a change of the orientation of a portion fixed by the roller pair is different from that of a portion near the ejection space 126 in which the orientation is flexibly changed. Specifically, when a portion of the document 401 in the opened ejection space 126 is displaced by a user operation, a portion near the ejection space 126 is considerably displaced in the downstream-side conveying path 120 according to the displacement but a displacement of a portion near the fixed end is limited. Thus, the sensor 113 is placed near the ejection space 126, thereby detecting a change of the orientation of the document 401 with high sensitivity. However, the location of the sensor is not limited to the foregoing location as long as a change of the orientation of the document can be accurately detected when a user holds the document in order to remove the document.

The CPU 202 compares the output of the sensor 113 and the threshold value S2 in parallel with the ejecting operation of the document 401. When the document 401 is removed from the document outlet 106 by the ejecting operation of the document 401 and collection by a user, the document 401 is not present in the detection region of the sensor 113, so that a value upon detection of the reflector plate 114 is outputted. In this case, the output of the sensor is equal to V1 in the output tables of FIGS. 5A and 5B, so that the CPU 202 determines that the output has exceeded the threshold value S2 as a result of comparison (S313). If the CPU 202 determines that the output of the sensor 113 has exceeded the threshold value S2, the CPU 202 transmits a stop control signal to the motor driver 206 in order to stop the rotation of the conveying motor 208. When the rotation of the conveying motor is stopped, the ejecting operation of the document 401 is completed.

According to the present example, a holding mechanism is automatically cancelled in response to a change of the state of a document, allowing a user to collect the document without operating a panel or the like. Specifically, when a large document is held so as not to fall out of the scanner due to the weight of the document, the document can be released without operating the panel. Thus, by collecting the document with both hands, damage caused by a drop or a bend of the document can be prevented.

The present example described the method of generating the threshold values based on the output of the sensor 113 when the document can be ejected. Predetermined fixed values may be used instead. For example, in the case of a configuration where a sheet type is determined and a distance between a sensor and a sheet is substantially kept constant in an ejection state, fixed threshold values can be used.

The present example described the configuration in which a sheet is held by energizing the conveying motor for rotating the ejection roller. A sheet may be held by another mechanism. For example, a sheet may be pressed by driving a spring retaining mechanism when the sheet can be ejected, or a sheet may be pressed by a suction pressure of a suction port provided on a conveying path. In other words, in addition to the conveying roller pair, a configuration only for the function of fixing, holding, and releasing a sheet, that is, a configuration separated from the conveying configuration may implement the holding portion of the present disclosure.

Figure 6A:
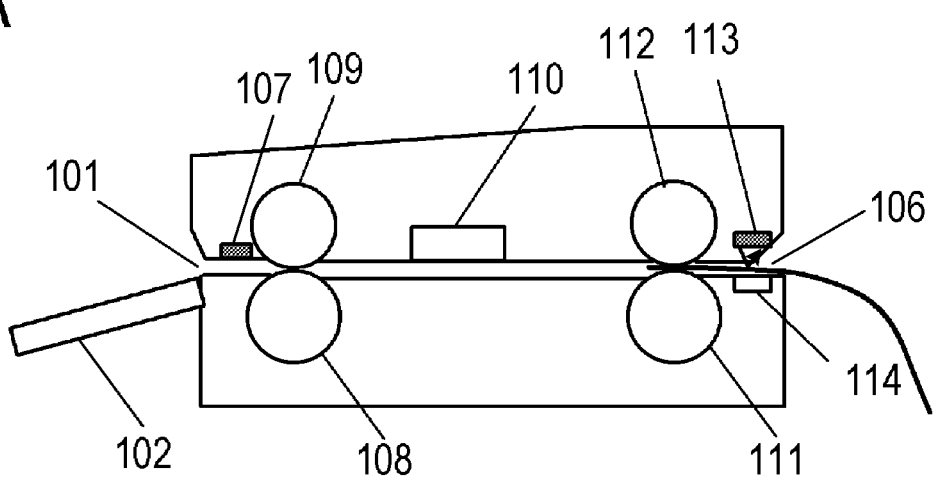
FIGS. 6A and 6B are schematic cross-sectional views illustrating the scanner not provided with a paper ejection guide.
Figure 6B:
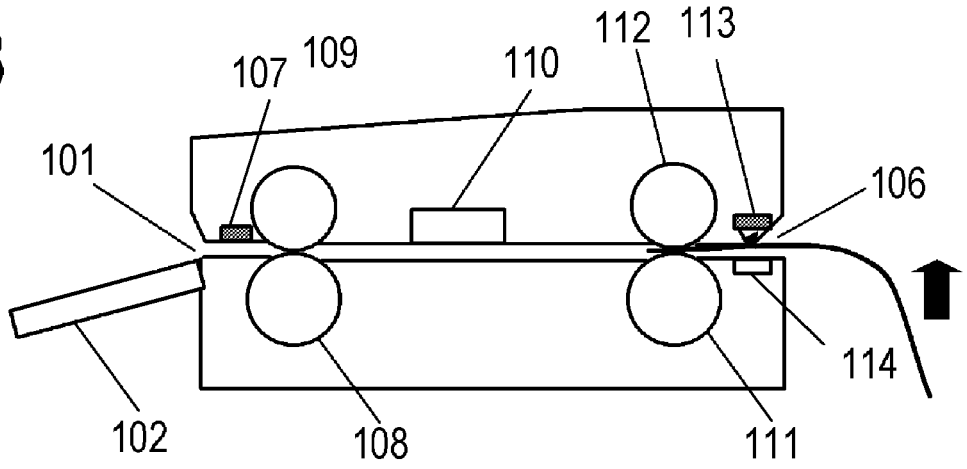

The present example described the configuration in which the read document 401 is guided toward the front of the scanner by the paper ejection guide 105. As illustrated in FIGS. 6A and 6B, similar control is applicable even if the paper ejection guide 105 is removed. For example, if the document 401 is thick, the use of the paper ejection guide 105 may affect the accuracy of conveying. In this case, the paper ejection guide 105 may be removed to eject the document 401 to the rear of the scanner. In addition, in this case, a distance to the document 401 is measured by the sensor 113 and the threshold value for determination is generated while the rear end of the document 401 is held by the document ejection roller 111 and the downstream-side pinch roller 112 after the completion of the reading of the document 401. A user moves to the rear of the scanner and collects the document 401. Before the user touches the document 401, the sensor 113 and the document 401 are separated from each other by the weight of the document 401 (FIG. 6A). Thus, when the user lifts the document 401, the sensor 113 and the document 401 are brought close to each other (FIG. 6B). In this case, the output of the sensor 113 is obtained as indicated by V3 in FIG. 5A and thus the CPU 202 determines that the output is smaller than the threshold value S1 and ejects the document 401. If the document 401 is to be collected by the user at the rear of the scanner, it is particularly difficult to confirm the operation panel 103 and perform a key operation. Thus, the operability can be improved by determining a state and automatically ejecting the document 401 as described herein.

The present example describes the configuration and control of a scanner. In the case of a multifunction printer (MFP) integrated with a printer, a printing operation may be performed by a printer unit concurrently with a reading operation of a document. In this case, vibrations caused by driving a carriage unit in the printer portion or vibrations caused by conveying the document 401 may affect a signal level detected by the state sensor 113. To address the issue, in the step of generating the threshold values, it is desirable or preferable to change an acquisition period for the output of the sensor 113 according to the period of vibrations caused by carriage or conveying in the printer portion and generate the threshold values including the range of fluctuations of the output, the fluctuations being caused by vibrations. In other words, the output of the sensor 113 is acquired several times during a predetermined detection period that is set based on the period of vibrations generated in the scanner. The threshold values are generated in consideration of the range of fluctuations. For example, in a method of setting a first threshold value, the mean value of the output of the sensor 113 may be used as the central value of a second detected distance (but is not limited thereto). Thus, the state of the document 401 is slightly changed by vibrations generated by the operation of the printer portion, thereby preventing the output of the sensor 113 from reaching the threshold value and causing a malfunction.

Processing for preventing the influence of vibrations caused by driving the printer portion may be performed during the determination of the output. In this case, in processing for comparing the output of the sensor 113 and the threshold value, if it is determined that a period during which the output of the sensor 113 reaches the threshold value is longer than the period of vibrations caused by driving the printer portion, the ejecting operation of the document is started. Specifically, the outputs of the sensor 113 are consecutively acquired in a period longer than the period of vibrations generated in the scanner. If the outputs are all kept at the threshold value, it is determined that an amount of change of the orientation of the document 401 has reached a predetermined amount. The period of vibrations generated in the scanner can be experimentally determined in advance.

Moreover, the state of the document 401 being ejected may be gradually changed by, for example, the weight of the document or the vibrations of the scanner. In this case, if the determination is continued with the threshold value generated by using the output of the sensor 113 immediately after reading, the output of the sensor may reach the threshold value before a user operates the document 401, so that document ejection control may be started. Thus, after the completion of reading of the document 401, the output of the sensor 113 may be acquired at regular cycles and a threshold value may be regenerated each time the output is acquired, that is, a distance between the sensor 113 and the document 401 may be redetected at predetermined cycles and the threshold value may be reset each time a distance is redetected. A user operation on the document makes a large amount of change in distance between the sensor 113 and the document 401 per unit time, so that a change by a user operation and a change without a user operation can be identified and the accuracy of determination can be improved.

The setting of the threshold value and the detection method are not limited as long as the held document can be released in response to a movement of the document by a user. In the foregoing example, the held document 401 is released by detecting a change of the orientation of the document 401 from a first orientation in contact with the lower edge of the document outlet 106 to a second orientation in contact with the upper edge of the document outlet 106 or vice versa. For example, the held document 401 may be released when a change from the first orientation to the second orientation and a change from the second orientation to the first orientation are repeated predetermined times.

Figure 7:
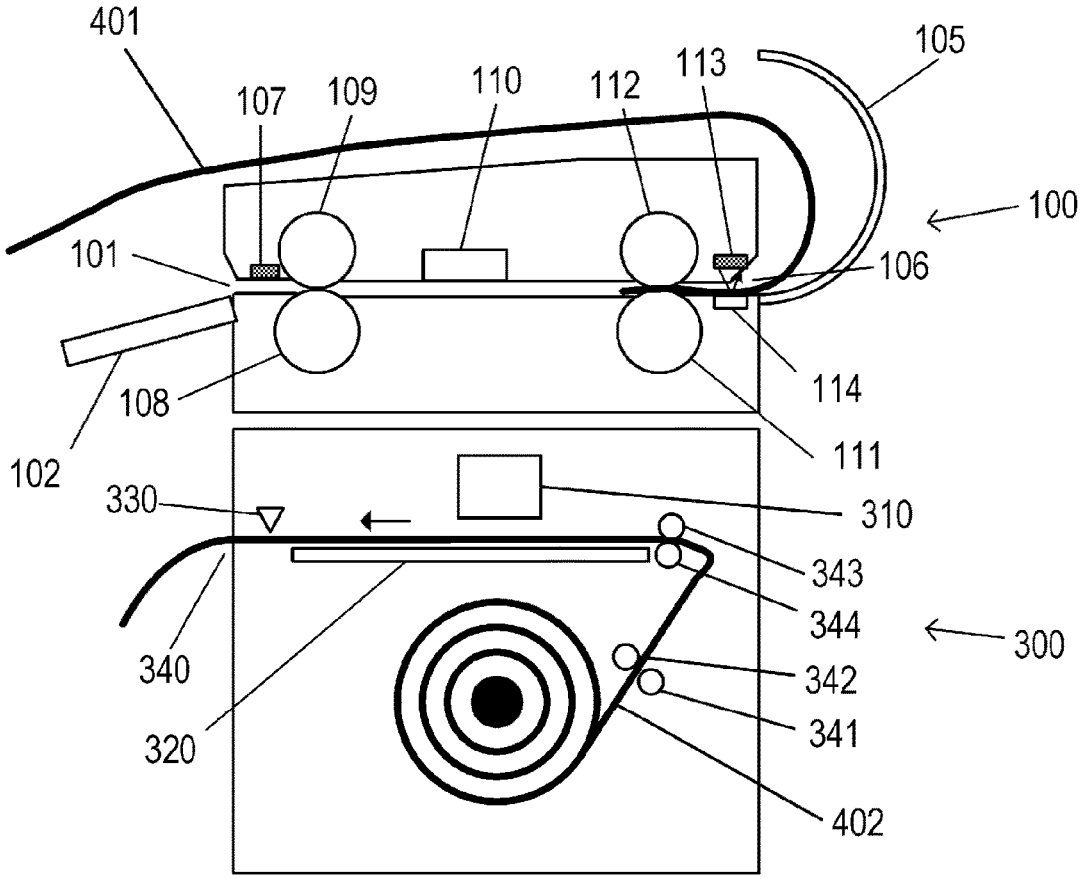
FIG. 7 is a schematic cross-sectional view illustrating the configuration of a copier according to the example of the present disclosure.

FIG. 7 is a schematic cross-sectional view illustrating a schematic configuration of a multifunction printer (MFP) used as a multifunction machine (image forming apparatus) according to the example of the present disclosure. The multifunction machine according to the present example mainly includes the scanner 100 serving as a scanner portion (image reading portion) and a printer (image recorder) 300 serving as a printer portion (image recording portion). The scanner 100 is installed on the printer 300. The multifunction machine of the present example is configured such that copy print data (image data) acquired from the document 401 by the scanner 100 can be transmitted to the printer 300. The printer 300 is configured so as to receive print data (image data) from external apparatuses such as a host computer as well as the copy print data from the scanner 100.

The printer 300 includes a paper conveying mechanism for a roll sheet 402 serving as a recording material and performs printing (records an image) on the roll sheet 402 based on the print data received from the outside or the copy print data read from the document 401 by the scanner 100. The roll sheet 402 fed with a predetermined conveying speed by the paper conveying mechanism has a surface supported by a platen 320 on the opposite side from a print surface and is printed by a recording head 310 that reciprocates in X direction perpendicular to the conveying direction with respect to the print surface. The recording head 310 performs printing by ejecting ink liquid onto the print surface of the roll sheet 402 from a nozzle. A printed (recorded) part of the roll sheet 402 is cut to a predetermined length by a cutter 330 and is outputted as a printed material from a document outlet 340.

The apparatus configuration of the printer 300 is not limited to a configuration including a roll sheet used as a recording material. The recording material on which an image is recorded may be a cut sheet having a predetermined length.

The application of the paper conveying device of the present disclosure is not limited to the paper conveying mechanism of a scanner according to the present example. For example, the present disclosure is also applicable to the conveying mechanism (including conveying rollers 341 to 344 and driving systems such as motors for driving the rollers) of the roll sheet 402 of the printer 300. In this case, the printer 300 serving as an image recorder corresponds to the paper processing device of the present disclosure and a print portion (recording portion) including the recording head 310 corresponds to the processing portion of the present disclosure. In this case, a conveying roller pair similar to the document ejection roller 111 and the downstream-side pinch roller 112 is disposed downstream of a carter 330. Furthermore, a printed-matter state sensor similar to the document state sensor 113 is disposed between the conveying roller pair and the document outlet 340. The control configuration and the control method are also identical to those of the scanner 100. This configuration can hold an outputted printed matter without dropping, reduce damage caused by dropping, and improve convenience for users in the collection of printed matters.

The image recording method of an image recorder to which the present disclosure is applicable is not limited to ink jet recording. For example, the present disclosure is applicable to the scanner of a multifunction machine including a laser printer using an electrophotographic system and the present disclosure is applicable to the recording-material conveying mechanism of a laser printer.

Moreover, predetermined processing to be performed on paper is not limited to the reading of an image and the recording of an image. The predetermined processing may include, for example, after treatment such as heat treatment on a recorded image. In other words, the present disclosure is also applicable to a conveying mechanism for a recording material in heat treatment equipment for heat-treating a recorded image.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-221953, filed on Dec. 9, 2019, which is hereby incorporated by reference herein in its entirety.

What is claimed is:

1. A paper conveying device comprising:

a conveying portion configured to convey, in a conveying direction, a paper to a processing portion of a paper processing device to perform predetermined processing on the paper;

a holding portion disposed downstream of the processing portion in the conveying direction and configured to hold the paper processed by the paper processing device;

a detection portion, including a sensor capable of detecting a distance between the sensor and a detection target, is configured to continuously detect a distance to the paper held by the holding portion in a predetermined period; and a control portion configured to release the paper held by the holding portion in a case where the distance continuously detected in a longer period is kept at a distance reaching a first threshold value.

2. The paper conveying device according to claim 1, wherein the holding portion holds an upstream end of the processed paper in the conveying direction, and wherein the detection portion is disposed downstream of the holding portion in the conveying direction.

3. The paper conveying device according to claim 1, wherein the conveying portion includes an upstream-side conveying roller pair disposed upstream of the processing portion in the conveying direction and the holding portion is a paper holding/conveying unit that includes a downstream-side conveying roller pair disposed downstream of the processing portion in the conveying direction, wherein, in a state in which the control portion stops rotation of the downstream-side conveying roller pair, the downstream-side conveying roller pair holds the processed paper between the downstream-side conveying roller pair, and wherein, in the case where the distance continuously detected in the longer period is kept at the distance reaching the first threshold value, the control portion releases the paper held by the downstream-side conveying roller pair by causing the downstream-side conveying roller pair to convey the paper and, after a rear end of the paper is conveyed to downstream of the holding portion in the conveying direction, the control portion stops the conveying of the paper by the downstream-side conveying roller pair.

4. The paper conveying device according to claim 1, wherein the conveying portion includes an upstream-side conveying roller pair disposed upstream of the processing portion in the conveying direction and the holding portion is a paper holding/conveying unit that includes a downstream-side conveying roller pair disposed downstream of the processing portion in the conveying direction, and wherein, in a state in which the control portion stops rotation of the downstream-side conveying roller pair, the downstream-side conveying roller pair holds the processed paper between the downstream-side conveying roller pair.

5. The paper conveying device according to claim 4, wherein, in the case where the distance continuously detected in the longer period is kept at the distance reaching the first threshold value, the control portion releases the paper by restarting the rotation of the downstream-side conveying roller pair, and wherein, in a case where, based on a detection result of the detection portion, detection is made that the paper has passed through a nip of the downstream-side conveying roller pair, the control portion stops the rotation of the downstream-side conveying roller pair.

6. The paper conveying device according to claim 1, wherein the predetermined period is a period that is longer than a period of vibrations generated in the paper conveying device.

7. The paper conveying device according to claim 1, wherein the conveying portion (i) has a downstream-side conveying path that is located downstream of the holding portion in the conveying direction and (ii) is configured to limit change of an orientation of the paper to a predetermined range, wherein, at downstream of the downstream-side conveying path, a space is formed that is configured to permit a change of the paper orientation to be more than the change of the paper orientation permitted by the downstream-side conveying path, and wherein the detection portion is located beside a downstream end of the downstream-side conveying path.

8. The paper conveying device according to claim 1, wherein the sensor includes a light source for illuminating the detection target with detection light and includes a light receiving unit for receiving detection light from the detection light reflected from the detection target, wherein a position of an optical axis of the reflected detection light received by the light receiving unit is changed according to a distance between the light source and the detection target, and wherein the sensor outputs an output value corresponding to the position of the optical axis.

9. The paper conveying device according to claim 1, wherein the first threshold value is set based on a first detected distance and a second detected distance, and wherein the first detected distance is detected by the sensor in absence of the paper being in a detection range of the sensor, and the second detected distance is detected by the sensor in a state where the paper processed by the processing portion is held by the holding portion.

10. The paper conveying device according to claim 9, wherein the first detected distance is detected before the processing portion starts processing the paper.

11. The paper conveying device according to claim 9, wherein the second detected distance is detected several times during a predetermined detection period that is set based on a period of vibrations generated in the paper conveying device, and wherein the first threshold value is set in consideration of a range of fluctuations of the second detected distance detected several times.

12. The paper conveying device according to claim 9, wherein the second detected distance is redetected at predetermined cycles, and wherein the first threshold value is reset at the predetermined cycles based on the second detected distance that is redetected at the predetermined cycles.

13. The paper conveying device according to claim 9, wherein, in a case where an absolute value of a difference between the first detected distance and the second detected distance is at least a predetermined reference value, the first threshold value is set at a distance that is longer than the second detected distance.

14. The paper conveying device according to claim 9, wherein, in a case where an absolute value of a difference between the first detected distance and the second detected distance is smaller than a predetermined reference value, the first threshold value is set at a distance that is shorter than the second detected distance.

15. The paper conveying device according to claim 14, wherein the predetermined reference value is a reference value for determining whether an orientation of the paper held by the holding portion is one of:

(i) a separated orientation in which a part of the paper included in the detection range of the sensor is located near a remotest position from the sensor, or (ii) a close orientation in which the part of the paper is located near a closest position to the sensor, wherein, in a case where the absolute value is smaller than the predetermined reference value, determination is made that the paper orientation held by the holding portion is the separated orientation, and in a case where the part of the paper is changed to an orientation brought closer to the sensor by a predetermined distance, the first threshold value is set as a threshold value for determining that an amount of the detected orientation change has reached a predetermined amount, and wherein, in a case where the absolute value is equal to or higher than the predetermined reference value, determination is made that the paper orientation held by the holding portion is the close orientation, and in a case where the part of the paper is changed to the orientation separated from the sensor by the predetermined distance, the first threshold value is set as the threshold value for determining that the amount of the detected orientation change has reached the predetermined amount.

16. The paper conveying device according to claim 1, wherein, in a case where the control portion releases the paper held by the holding portion and causes the conveying portion to conveying the paper, in a case where the distance between the sensor and the detection target detected by the sensor reaches a second threshold value, the control portion stops the conveying of the paper.

17. The paper conveying device according to claim 16, wherein the second threshold value is a threshold value for determining whether the paper is located downstream of a position where the holding portion is able to hold the paper, and wherein, in absence of the paper being in a detection range of the sensor, the second threshold value is set to a value which is larger than a first detected distance detected by the sensor and, in a state where the processed paper is held by the holding portion, the second threshold value is set to a value which is smaller than a second detected distance detected by the sensor.

18. The paper conveying device according to claim 1, further comprising a reading portion configured to read an image on the paper conveyed by the conveying portion.

19. The paper conveying device according to claim 18, further comprising an image recording portion configured to record, on recording material, the image read by the reading portion.

20. A method for a paper conveying device having a conveying portion, a holding portion disposed downstream of a processing portion of a paper processing device in a conveying direction, and a detection portion including a sensor capable of detecting a distance between the sensor and a detection target, the method comprising:

conveying, by the conveying portion in the conveying direction, a paper to the processing portion of a paper processing device to perform predetermined processing on the paper;

holding, by the holding portion, the paper processed by the paper processing device;

detecting continuously, by the detection portion, a distance to the paper held by the holding portion in a predetermined period; and releasing the paper held by the holding portion in a case where the distance continuously detected in a longer period is kept at a distance reaching a first threshold value.

21. A non-transitory computer-readable storage medium storing a program to cause a computer to perform a method for a paper conveying device having a conveying portion, a holding portion disposed downstream of a processing portion of a paper processing device in a conveying direction, and a detection portion including a sensor capable of detecting a distance between the sensor and a detection target, the method comprising:

conveying, by the conveying portion in the conveying direction, a paper to the processing portion of a paper processing device to perform predetermined processing on the paper;

holding, by the holding portion, the paper processed by the paper processing device;

detecting continuously, by the detection portion, a distance to the paper held by the holding portion in a predetermined period; and releasing the paper held by the holding portion in a case where the distance continuously detected in a longer period is kept at a distance reaching a first threshold value.

22. A paper conveying device comprising:

a conveying portion configured to convey, in a conveying direction, a paper to a processing portion of a paper processing device to perform predetermined processing on the paper;

a holding portion disposed downstream of the processing portion in the conveying direction and configured to hold the paper processed by the paper processing device;

a detection portion, including a sensor capable of detecting a distance between the sensor and a detection target, is configured to continuously detect a distance to the paper held by the holding portion in a predetermined period; and a control portion configured to release the paper held by the holding portion, wherein a first threshold value is set based on a detected distance detected by the sensor in a state where the paper processed by the processing portion is held by the holding portion and further set based on a detected distance detected by the sensor in absence of the paper being in a detection range of the sensor, and wherein the control portion releases the paper processed by the processing portion and held by the holding portion in a case where the distance continuously detected by the detection portion is longer than the first threshold value.

23. The paper conveying device according to claim 22, wherein the distance detected the state is detected several times during a predetermined detection period.

24. The paper conveying device according to claim 22, wherein the distance detected the state is redetected at predetermined cycles.

25. The paper conveying device according to claim 22, wherein, in a case where an absolute value of a difference between the distance detected the state and the detected distance detected by the sensor in the absence of the paper being in the detection range of the sensor is at least a predetermined reference value, the first threshold value is set at a distance that is longer than the distance detected the state.

26. The paper conveying device according to claim 22, wherein, in a case where an absolute value of a difference between the distance detected in the state and the detected distance detected by the sensor in the absence of the paper being in the detection range of the sensor is smaller than a predetermined reference value, the first threshold value is set at a distance that is shorter than the distance detected in the state.

27. The paper conveying device according to claim 26, wherein the predetermined reference value is a reference value for determining whether an orientation of the paper held by the holding portion is one of:

(i) a separated orientation in which a part of the paper included in the detection range of the sensor is located near a remotest position from the sensor, or (ii) a close orientation in which the part of the paper is located near a closest position to the sensor, wherein, in a case where the absolute value is smaller than the predetermined reference value, determination is made that the paper orientation held by the holding portion is the separated orientation, and in a case where the part of the paper is changed to an orientation brought closer to the sensor by a predetermined distance, the first threshold value is set as a threshold value for determining that an amount of the detected orientation change has reached a predetermined amount, and wherein, in a case where the absolute value is equal to or higher than the predetermined reference value, determination is made that the paper orientation held by the holding portion is the close orientation, and in a case where the part of the paper is changed to the orientation separated from the sensor by the predetermined distance, the first threshold value is set as the threshold value for determining that the amount of the detected orientation change has reached the predetermined amount.

28. The paper conveying device according to claim 22, wherein the holding portion is a paper holding/conveying unit configured to hold and convey the paper processed by the paper processing device, and wherein, in a case where the control portion releases the paper held by the holding portion and the distance between the sensor and the detection target detected by the sensor reaches a second threshold value, the control portion stops conveying of the paper.

29. The paper conveying device according to claim 28, wherein the second threshold value is a threshold value for determining whether the paper is located downstream of a position where the holding portion is able to hold the paper, and wherein, in the absence of the paper being in the detection range of the sensor, the second threshold value is set to a value which is larger than a first detected distance detected by the sensor and, in a state where the processed paper is held by the holding portion, the second threshold value is set to a value which is smaller than a second detected distance detected by the sensor.

30. The paper conveying device according to claim 22, further comprising a reading portion configured to read an image on the paper conveyed by the conveying portion.

31. The paper conveying device according to claim 30, further comprising an image recording portion configured to record, on recording material, the image read by the reading portion.

32. A method for a paper conveying device having a conveying portion, a holding portion disposed downstream of a processing portion of a paper processing device in a conveying direction, and a detection portion including a sensor capable of detecting a distance between the sensor and a detection target, the method comprising:

conveying, by the conveying portion in the conveying direction, a paper to the processing portion of a paper processing device to perform predetermined processing on the paper;

holding, by the holding portion, the paper processed by the paper processing device;

detecting continuously, by the detection portion, a distance to the paper held by the holding portion in a predetermined period, wherein a first threshold value is set based on a detected distance detected by the sensor in a state where the paper processed by the processing portion is held by the holding portion and further set based on a detected distance detected by the sensor in absence of the paper being in a detection range of the sensor; and releasing the paper processed by the processing portion and held by the holding portion in a case where the distance continuously detected by the detection portion is longer than the first threshold value.

* * * * *